US010724518B2

(12) United States Patent
Araki et al.

(10) Patent No.: US 10,724,518 B2
(45) Date of Patent: Jul. 28, 2020

(54) GEAR PUMP

(71) Applicant: TBK Co., Ltd., Machida-shi, Tokyo (JP)

(72) Inventors: Makoto Araki, Isehara (JP); Hirotada Yoshitani, Yamato (JP)

(73) Assignee: TBK CO., LTD., Machida-shi, Tokyo (JP)

( * ) Notice: Subject to any disclaimer, the term of this patent is extended or adjusted under 35 U.S.C. 154(b) by 175 days.

(21) Appl. No.: 15/745,488

(22) PCT Filed: May 18, 2015

(86) PCT No.: PCT/JP2015/002491

§ 371 (c)(1),
(2) Date: Jan. 17, 2018

(87) PCT Pub. No.: WO2016/185503

PCT Pub. Date: Nov. 24, 2016

(65) Prior Publication Data

US 2018/0209416 A1 Jul. 26, 2018

(51) Int. Cl.
*F04C 2/10* (2006.01)
*F04C 15/00* (2006.01)
(Continued)

(52) U.S. Cl.
CPC ..... *F04C 2/10* (2013.01); *F04C 2/101* (2013.01); *F04C 2/102* (2013.01); *F04C 11/001* (2013.01);
(Continued)

(58) Field of Classification Search
CPC ..... F04C 11/001; F04C 15/0042; F04C 15/0069; F04C 15/06; F04C 2210/206;
(Continued)

(56) References Cited

U.S. PATENT DOCUMENTS 2,745,355 A * 5/1956 Mosbacher ..... F04C 5/00 418/4
6,299,422 B1 * 10/2001 Woodhouse ..... F04C 2/14 418/153
(Continued)

FOREIGN PATENT DOCUMENTS

CN 201176930 Y 1/2009
GB 1297002 A 11/1972
(Continued)

OTHER PUBLICATIONS

Office Action dated Sep. 4, 2018, issued in counterpart Chinese Application No. 201580080129.0, with English translation. (13 pages).
(Continued)

*Primary Examiner* — Patrick Hamo
*Assistant Examiner* — Paul W Thiede
(74) *Attorney, Agent, or Firm* — Westerman, Hattori, Daniels & Adrian, LLP

(57) ABSTRACT

A gear pump according to the present invention is configured such that a first pump chamber comprises a first intake space into which a fluid is taken in and a first discharge space from which the fluid is discharged, in accordance with rotation of an internal gear and external gears, a second pump chamber comprises a second intake space into which the fluid is taken in and a second discharge space from which the fluid is discharged, in accordance with rotation of the internal gear and the external gears, the first intake space and the second intake space are provided to be symmetrical about a rotational center of the internal gear, and the first discharge space and the second discharge space are provided to be symmetrical about the rotational center of the internal gear.

2 Claims, 4 Drawing Sheets

(51) Int. Cl.
*F04C 11/00* (2006.01)
*F04C 15/06* (2006.01)

(52) U.S. Cl.
CPC ..... *F04C 15/0042* (2013.01); *F04C 15/06* (2013.01); *F04C 15/0069* (2013.01); *F04C 2210/206* (2013.01); *F04C 2240/70* (2013.01)

(58) Field of Classification Search
CPC ..... F04C 2240/70; F04C 2/10; F04C 2/101; F04C 2/102
USPC ..... 418/171, 61.1, 128, 131, 132, 165, 166, 418/172, 191; 475/107
See application file for complete search history.

(56) References Cited

U.S. PATENT DOCUMENTS

2011/0130236 A1* 6/2011 El-Zein ..... B60T 10/04 475/107
2016/0186753 A1 6/2016 Oda et al.

FOREIGN PATENT DOCUMENTS

JP 2015-36517 A 2/2015
WO 1999/019606 A1 4/1999

OTHER PUBLICATIONS

International Search Report dated Aug. 11, 2015, issued in counterpart application No. PCT/JP2015/002491 (2 pages).
Notification of Transmittal of Translation of the International Preliminary Report on Patentability (Form PCT/IB/338) of International Application No. PCT/JP2015/002491 dated Nov. 30, 2017 with Forms PCT/IB/373 and PCT/ISA/237. (6 pages).
Office Action dated Jan. 8, 2019, issued in counterpart Japanese Application No. 2017-518617, with English machine translation. (4 pages).

* cited by examiner

GEAR PUMP

TECHNICAL FIELD

The present invention relates to an internal gear pump that pumps a fluid in accordance with rotation of a gear.

TECHNICAL BACKGROUND

An internal gear pump includes: an internal gear (outer rotor) formed to have an annular shape and have internal teeth; an external gear (inner rotor), having external teeth that can mesh with the internal teeth, provided on the inner circumference side of the internal gear; and a housing that rotatably accommodates and holds the internal gear and the external gear. A plurality of meshing gaps (pump chambers) are defined between tooth surfaces of the internal gear and the external gear along a rotation direction of the internal gear. Each pump chamber rotationally moves in accordance with rotation of the internal gear and the external gear, in mesh with each other, to have a volume repeatedly increased and decreased through movement from one tooth to the other. In the housing, an intake port in communication with an intake area, in which the volume of the pump chamber increases in accordance with the rotation of the gears, is formed, and a discharge port in communication with a discharge area, in which the volume of the pump chamber decreases in accordance with the rotation of the gears, is formed. A fluid taken into the pump chamber through the intake port is sent from the intake area to the discharge area due to the rotation of the gears, to be discharged through the discharge port.

PRIOR ARTS LIST

Patent Document

Patent Document 1: Japanese Laid-Open Patent Publication No. 2015-36517(A)

SUMMARY OF THE INVENTION

Problems to be Solved by the Invention

In such a conventional gear pump, the pressure in the discharge area becomes higher than the pressure in the intake area as a result of the rotation of the gears. Increase in such a pressure difference between the intake area and the discharge area results in unbalanced pressure. Thus, the internal gear receives outward pressure to slide while being strongly pressed against the inner circumference surface of the housing (sliding resistance increases). As a result, extra driving force is required and machine efficiency is compromised.

The present invention is made in view of the problem described above, and an object of the present invention is to provide a gear pump with a lower risk of compromising machine efficiency.

Means to Solve the Problems

A gear pump according to the present invention for achieving the object described above comprises: an internal gear having an annular shape and having internal teeth on an inner circumference side; a first external gear and a second external gear each having external teeth on an outer circumference side, the external teeth capable of meshing with the internal teeth, the first external gear and the second external gear being provided on the inner circumference side of the internal gear; and a housing configured to rotatably hold the internal gear, the first external gear, and the second external gear. A pump chamber is defined in the housing by the inner circumference side of the internal gear and the outer circumference sides of the first external gear and the second external gear. The housing comprises a partitioning portion that is provided between the first external gear and the second external gear to divide the pump chamber into a first pump chamber that is provided on the first external gear side and a second pump chamber provided on the second external gear side. The first pump chamber comprises a first intake space into which a fluid is taken in and a first discharge space from which the fluid is discharged, in accordance with rotation of the internal gear and the external gears. The second pump chamber comprises a second intake space into which the fluid is taken in and a second discharge space from which the fluid is discharged, in accordance with rotation of the internal gear and the external gears. The first intake space and the second intake space are provided to be symmetrical about a rotational center of the internal gear, and the first discharge space and the second discharge space are provided to be symmetrical about the rotational center of the internal gear.

In the gear pump according to the present invention, the partitioning portion preferably comprises: a first circumference surface that comes into slidable contact with the external teeth of the first external gear; a second circumference surface that comes into slidable contact with the external teeth of the second external gear; and a pair of third circumference surfaces that comes into slidable contact with the internal teeth of the internal gear. The fluid in the first intake space preferably fills a space between a tooth space of the first external gear and the first circumference surface to be sent to the first discharge space and fills a space between a tooth space of the internal gear and one of the third circumference surfaces to be sent to the second discharge space, in accordance with the rotation of the internal gear and the external gears. The fluid in the second intake space preferably fills a space between a tooth space of the second external gear and the second circumference surface to be sent to the second discharge space and fills a space between a tooth space of the internal gear and another one of the third circumference surfaces to be sent to the first discharge space, in accordance with the rotation of the internal gear and the external gears.

Advantageous Effects of the Invention

In the gear pump according to the present invention, the first intake space and the second intake space as well as the first discharge space and the second discharge space are arranged symmetrically about the rotational center of the internal gear, so that the pressure in the internal gear is balanced. Thus, the internal gear can be self aligned so that the axis of the internal gear and the axis of the housing can be in an appropriate positional relationship, whereby sliding friction between the outer circumference surface of the internal gear and the inner circumference surface of the housing is less likely to be produced. As a result, the pump can have higher machine efficiency with frictional torque loss reduced.

In the gear pump according to the present invention, the oil in the first intake space is sent to the first discharge space and the second discharge space respectively through the tooth space of the first external gear and the tooth space of the internal gear. Furthermore, the oil in the second intake space is sent to the first discharge space and the second discharge space respectively through the tooth space of the second external gear and the tooth space of the internal gear. This ensures two oil sending routes for between each of the intake spaces and the discharge spaces. Thus, the oil in the intake spaces can be efficiently sent to the discharge spaces.

DESCRIPTION OF THE EMBODIMENTS

Figure 1:
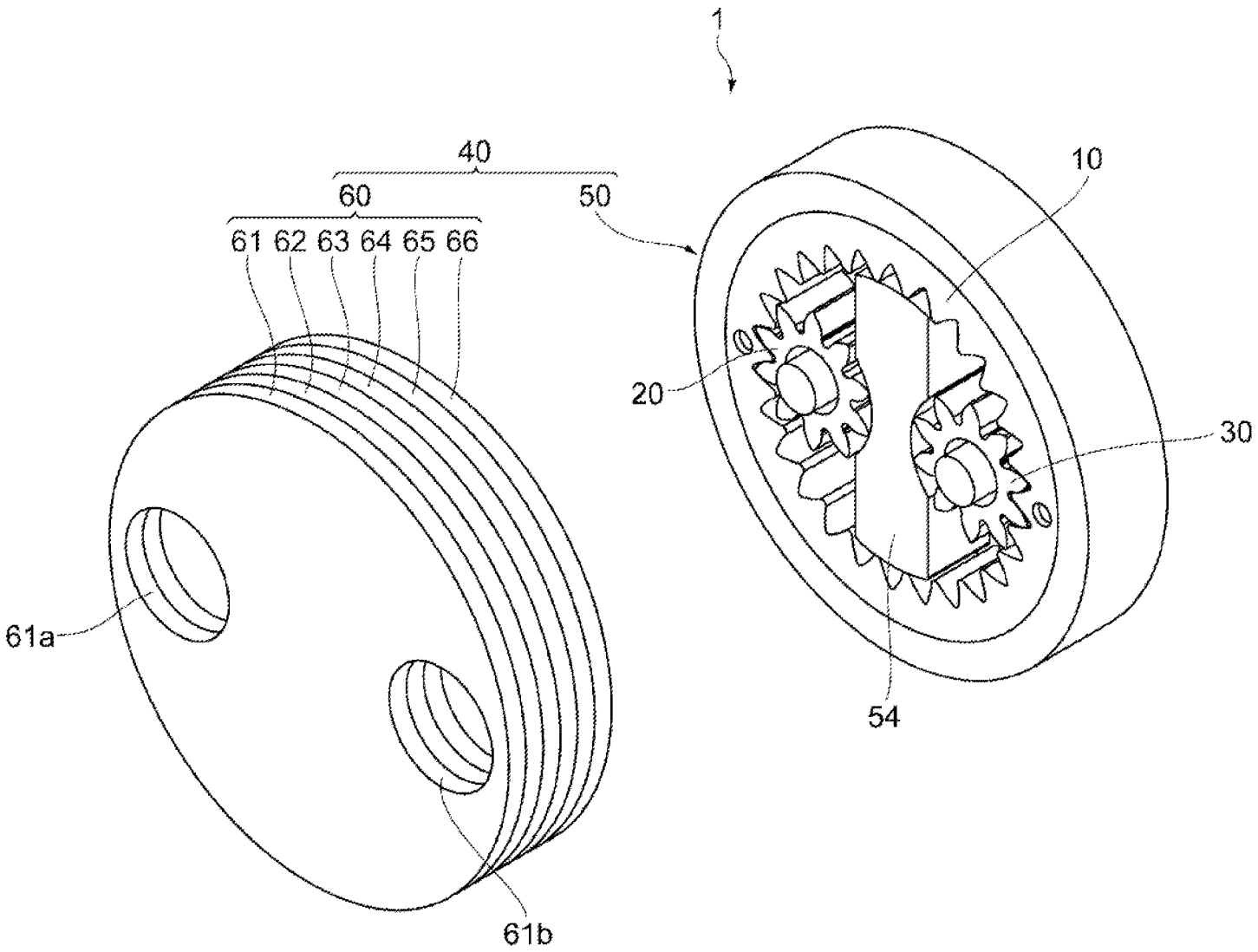
FIG. 1 is a perspective view of a gear pump according to the present embodiment.

A preferred embodiment of the present invention is described below with reference to the drawings. A gear pump 1 according to one embodiment of the present invention is formed as a motor oil pump that includes a motor rotor and a motor stator, and is applied to a hydraulic device or the like of a vehicle. First of all, an overall configuration of the gear pump 1 according to the present embodiment is described with reference to FIG. 1 to FIGS. 3A-3F.

The gear pump 1 mainly includes: an internal gear 10 having internal teeth 11; a first external gear 20 having external teeth 21 that can mesh with the internal teeth 11; a second external gear 30 having external teeth 31 that can mesh with the internal teeth 11; and a housing 40 that rotatably accommodates and holds the gears 10, 20, and 30.

The internal gear 10 is an annular gear that has a plurality of internal teeth 11 formed along a circumference direction and is provided to be rotatable about an axis O1. The first external gear 20 and the second external gear 30 are provided in a portion inside (on the inner circumference side of) the internal gear 10. The internal gear 10 has an outer circumference surface (surface portion) provided with a plurality of alternate N and S permanent magnets (not illustrated) arranged at an equal interval with multipole magnetization. Thus, the internal gear 10 in this example functions as a motor rotor.

The external gears 20 and 30 are spur gears respectively having a plurality of external teeth 21 and a plurality of external teeth 31 formed along the circumference direction and are each provided to be rotatable about a corresponding one of axes O2 and O3. The axes O2 and O3 of the external gears 20 and 30 are in parallel with the axis O1 of the internal gear 10. The first external gear 20 and the second external gear 30 are provided, on the inner circumference side of the internal gear 10, to be symmetrical about the axis O1 of the internal gear 10. The first external gear 20 is coupled to a shaft portion 23 extending in an axial direction. The second external gear 30 is coupled to a shaft portion 33 extending in the axial direction. The shaft portions 23 and 33 of the external gears 20 and 30 are rotatably supported via unillustrated bearings provided to the housing 40. The external gears 20 and 30 are formed to have the same structure (formed to have the same cross-sectional shape).

The housing 40 includes: a pump casing 50 having a hollow portion 51 formed to be capable of accommodating and holding the gears 10, 20, and 30 therein; and a pump cover 60 that is detachably attached to the pump casing 50 to close the hollow portion 51. The hollow portion 51 incorporates the internal gear 10 and the pair of external gears 20 and 30 in a state of being meshed with each other. In the hollow portion 51, a pump chamber P is formed as an area defined by the inner circumference side of the internal gear 10 and the outer circumference sides of the external gears 20 and 30. A pump cover 60 side of the internal gear 10 in the axial direction is also referred to as a "first end side" and a pump casing 50 side of the internal gear 10 in the axial direction is also referred to as a "second end side", based on the orientation of the gear pump 1 arranged as illustrated in FIG. 1, for the sake of description.

The pump casing 50 includes a cylindrical portion 52 that extends in the axial direction and a base wall portion 53 integrally formed on the second end side of the cylindrical portion 52, and has a bottomed hollow cylindrical shape as a whole. The above-described hollow portion 51, having a cylindrical shape, is defined by the cylindrical portion 52 and the base wall portion 53. The internal gear 10 is inserted into the hollow portion 51 in such a manner that the outer circumference surface of the internal gear 10 can be in slidable contact with the inner circumference surface of the cylindrical portion 52. The pair of external gears 20 and 30 is rotatably supported on the base wall portion 53 via unillustrated bearings. In the hollow portion 51, a dumbbell-shaped partitioning portion 54 protrudes from the center of the first end side of the base wall portion 53 to be positioned between the pair of external gears 20 and 30, on the inner side of the internal gear 10. As illustrated in FIG. 1, the internal gear 10, the external gears 20 and 30, the cylindrical portion 52, and the partitioning portion 54 are provided to have the first end sides in a substantially flush state.

The cylindrical portion 52 of the pump casing 50 incorporates an unillustrated motor stator. The motor stator is formed with a coil wound around an iron core, which is a magnetic member having a shaft form, via a bobbin. When the coil is energized, a magnetic field is generated, whereby the internal gear (motor rotor) 10 is drivingly rotated. The motor stator has an inner circumference surface facing the outer circumference surface (permanent magnet) of the internal gear 10 with a slight gap in between.

The partitioning portion 54 includes: a first circumference surface 55 having an arched recess form with substantially the same curvature of radius as a tooth tip circle diameter (outer diameter) of the first external gear 20 so that the external teeth 21 can be in slidable contact with the first circumference surface 55; a second circumference surface 56 having an arched recess form with substantially the same curvature of radius as a tooth tip circle diameter (outer diameter) of the second external gear 30 so that the external teeth 31 can be in slidable contact with the second circumference surface 56; and a pair of third circumference surfaces 57 having an arched protrusion form with substantially the same curvature of radius as a tooth tip circle diameter (inner diameter) of the internal gear 10 so that the internal teeth 11 can be in slidable contact with the third circumference surfaces 57.

Tooth spaces 12, 22, and 32, to be filled with oil to be pumped, are each formed between teeth of a corresponding one of the gears 10, 20, and 30. The tooth space 12 of the internal gear 10 is closed within the third circumference surface 57, the base wall portion 53, and the pump cover 60. The tooth space 22 of the first external gear 20 is closed within the first circumference surface 55, the base wall portion 53, and the pump cover 60. The tooth space 32 of the second external gear 30 is closed within the second circumference surface 56, the base wall portion 53, and the pump cover 60.

The gears 10, 20, and 30 are clamped between the pump casing 50 and the pump cover 60 so as to have the movement in the axial direction restricted within the hollow portion 51 and to be provided with side sealing.

Figure 2:
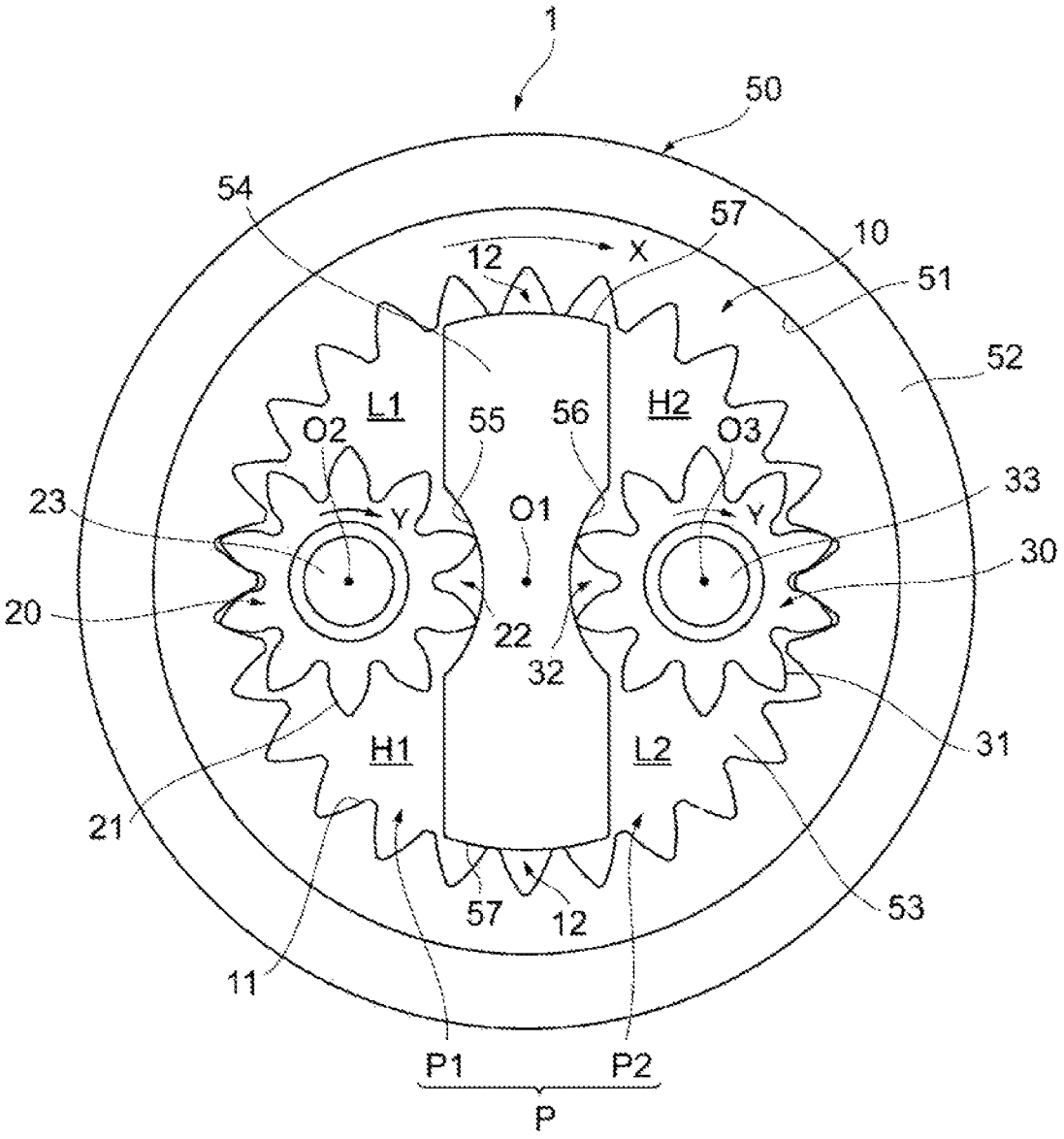
FIG. 2 is a front view of the gear pump (in a state where a pump cover is detached).
Figure 3:
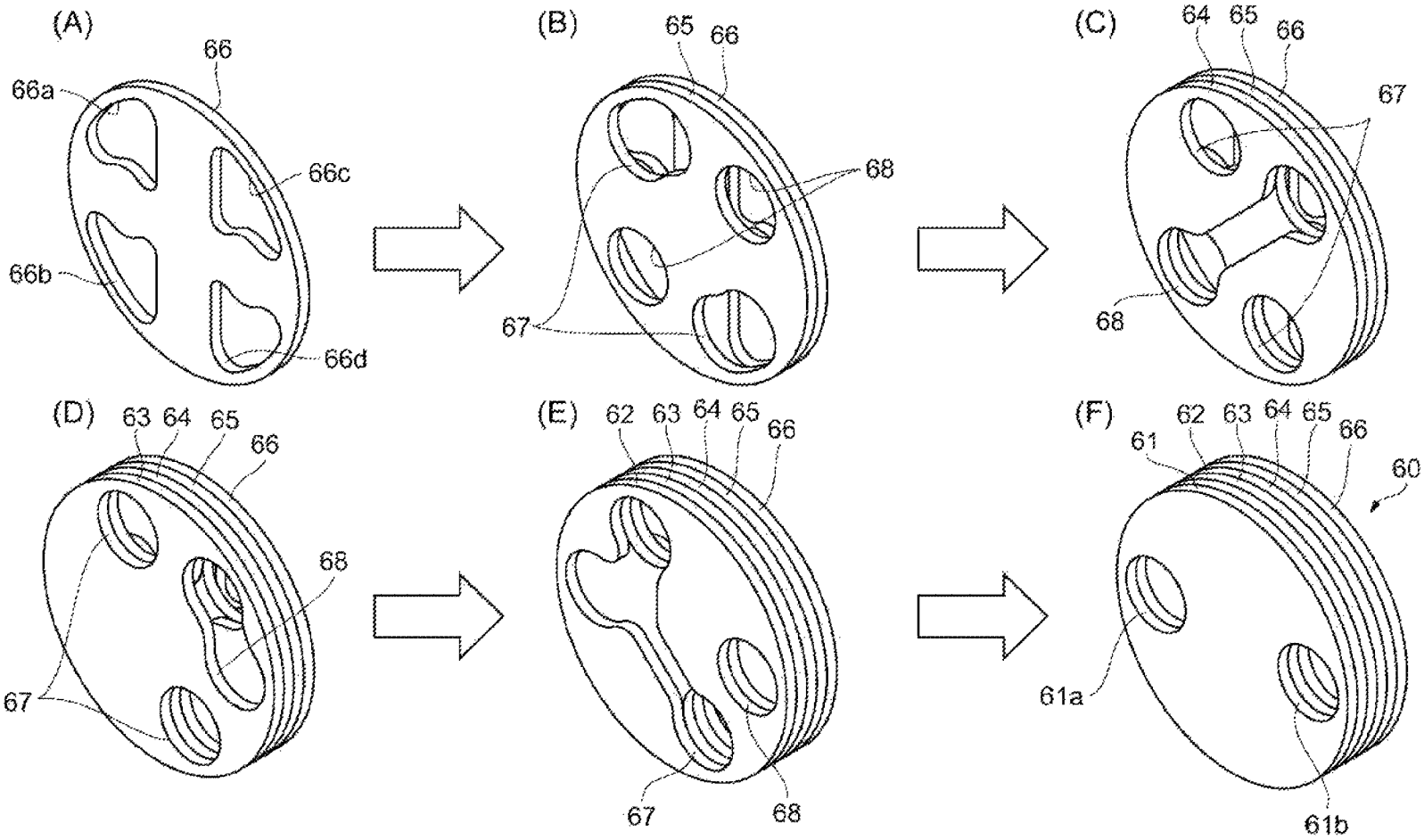
FIGS. 3A-3F are perspective views illustrating a structure of the pump cover.

The partitioning portion 54 of the pump casing 50 divides the pump chamber P in the internal gear 10 into a first pump chamber P1 on the first external gear 20 side and a second pump chamber P2 on the second external gear 30 side. In FIG. 2, the first pump chamber P1 and the second pump chamber P2 are respectively provided on the left and the right sides of the partitioning portion 54. The first pump chamber P1 includes a first intake space L1 and a first discharge space H1 respectively in communication with a first inlet hole 66*a* and a first discharge hole 66*b* of the pump cover 60. The second pump chamber P2 includes a second intake space L2 and a second discharge space H2 respectively in communication with a second inlet hole 66*c* and a second discharge hole 66*d* of the pump cover 60. The intake spaces L1 and L2 as well as the discharge spaces H1 and H2 are separated from each other with the external gears 20 and 30 being in mesh with the internal gear 10.

The pump cover 60 is formed with a plurality of (six in this example) disk portions 61 to 66, with the same shape, concentrically stacked as illustrated in FIGS. 3A-3F. Specifically, the six disk portions 61 to 66 are combined with each other in the order of FIG. 3A→3B→3C→3D→3E→3F. More specifically, the pump cover 60 includes a first disk portion 61, a second disk portion 62, a third disk portion 63, a fourth disk portion 64, a fifth disk portion 65, and a sixth disk portion 66 that are concentrically arranged in this order from the first end side toward the second end side in the axial direction, and are integrally fixed to each other by welding, bonding, pressure welding, or the like for example. The pump cover 60 includes: an intake flow channel 67 through which oil is flows into the intake spaces L1 and L2; and a discharge flow channel 68 through which the oil is discharged from the discharge spaces H1 and H2.

The first disk portion 61 is provided with: an intake port 61*a*, for taking in the oil, connected to an external inlet pipe (not illustrated); and a discharge port 61*b*, for discharging the oil, connected to an external discharge pipe (not illustrated). The sixth disk portion 66 is provided with: a first inlet hole 66*a* that is aligned with the first intake space L1 and is in communication with the first intake space L1; a first discharge hole 66*b* that is aligned with the first discharge space H1 and is in communication with the first discharge space H1; a second inlet hole 66*c* that is aligned with the second intake space L2 and is in communication with the second intake space L2; and a second discharge hole 66*d* that is aligned with the second discharge space H2 and is in communication with the second discharge space H2. The second disk portion 62, the third disk portion 63, the fourth disk portion 64, and the fifth disk portion 65 are provided with: an intake flow channel 67 that establishes connection and communication between the intake port 61*a* and the first and the second inlet holes 66*a* and 66*c*; and a discharge flow channel 68 that establishes connection and communication between the discharge port 61*b* and the first and the second discharge holes 66*b* and 66*d*. With this configuration, the oil taken in from the intake port 61*a* of the pump cover 60 is branched by the intake flow channel 67 to be introduced into the first intake space L1 and the second intake space L2 of the pump casing 50 from the first inlet hole 66*a* and the second inlet hole 66*c*. The oil sent from the first discharge space H1 of the pump casing 50 to the first discharge hole 66*b* of the pump cover 60 and the oil sent from the second discharge space H2 of the pump casing 50 to the second discharge hole 66*d* of the pump cover 60 join at the discharge flow channel 68 to be discharged through the discharge port 61*b*.

Figure 4:
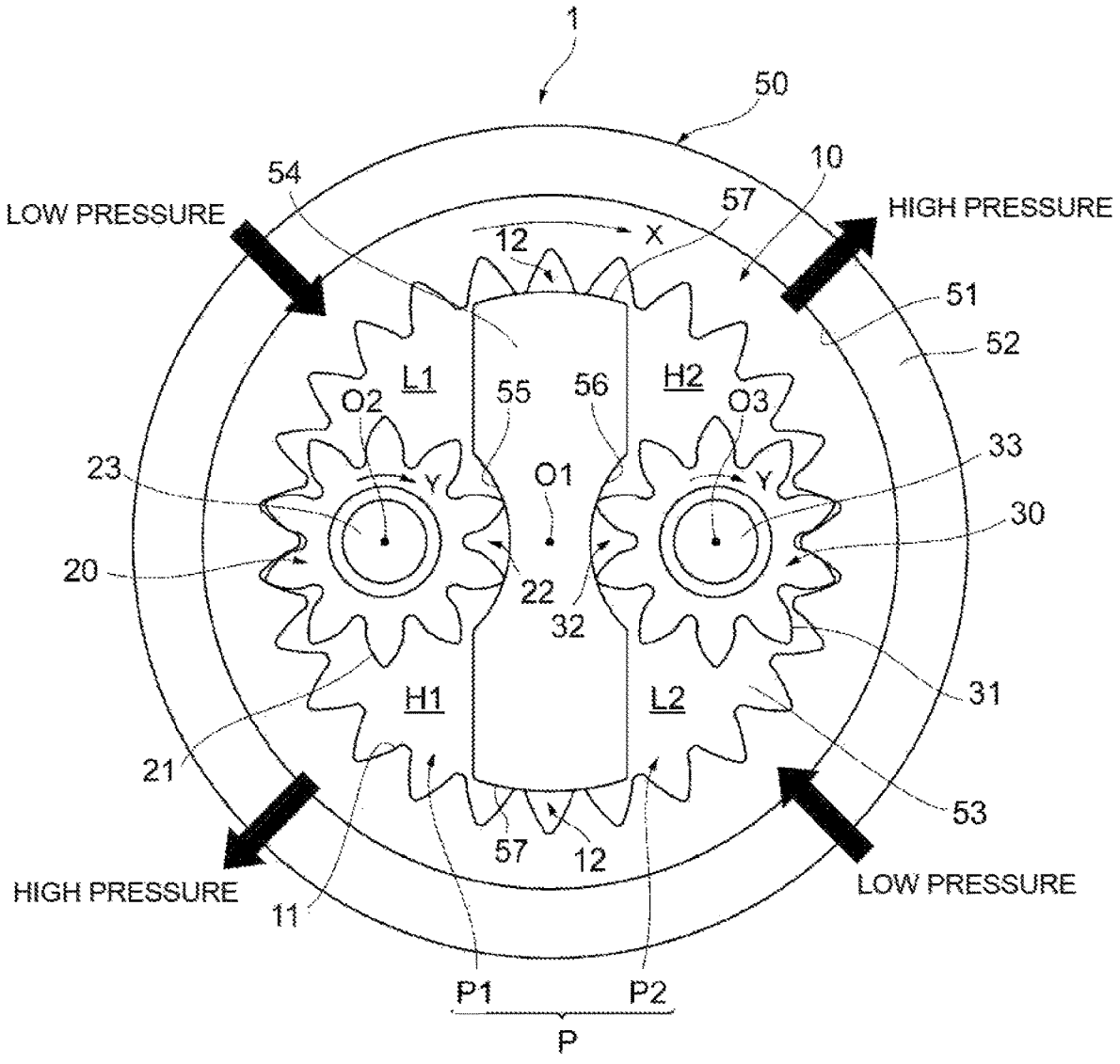
FIG. 4 is a front view illustrating an operation in the gear pump (in the state where the pump cover is detached).

Next, an operation in the gear pump 1 according to the present embodiment is described by further referring to FIG. 4. First of all, the motor stator (coil) incorporated in the housing 40 is energized, so that the internal gear (motor rotor) 10 is drivingly rotated in a direction indicated by an arrow X. Thus, the external gears 20 and 30, in mesh with the internal gear 10, are driven to rotate in a direction indicated by an arrow Y. When the internal gear 10 and the external gears 20 and 30 in mesh with each other rotate, the oil from the outside is taken into the first intake space L1 and the second intake space L2 of the housing 40. As a result of the rotation of the internal gear 10 and the first external gear 20, the tooth space 22 of the first external gear 20 is filled with the oil that has flowed into the first intake space L1, and the oil is sent to the first discharge space H1 while being trapped in the tooth space 22. Furthermore, the tooth space 12 of the internal gear 10 is filled with the oil, and the oil is sent to the second discharge space H2 while being trapped in the tooth space 12. As a result of the rotation of the internal gear 10 and the second external gear 30, the tooth space 32 of the second external gear 30 is filled with the oil that has flowed into the second intake space L2, and the oil is sent to the second discharge space H2 while being trapped in the tooth space 32. Furthermore, the tooth space 12 of the internal gear 10 is filled with the oil, and the oil is sent to the first discharge space H1 while being trapped in the tooth space 12. Thus, the rotation of the internal gear 10 and the external gears 20 and 30 causes the oil to be taken into the intake spaces L1 and L2 having the pressure dropped (to serve as low pressure areas) due to separation of the tooth surfaces from each other as a result of the rotation, and also causes the oil to be discharged from the discharge spaces H1 and H2 having the pressure risen (to serve as high pressure areas) due to approaching of the tooth surfaces toward each other as a result of the rotation. In this manner, oil intake and discharge operations are repeated in accordance with the rotation of the gears 10, 20, and 30.

As described above, the pump chamber P in the housing 40 has the first intake space L1 and the second intake space L2 serving as the low pressure areas and the first discharge space H1 and the second discharge space H2 serving as the high pressure areas. Thus, a pressure difference (high-low pressure difference) between the low pressure area and the high pressure area is produced in the inner circumference side of the internal gear 10. In view of this, in the present embodiment, the intake spaces L1 and L2 (the low pressure areas) in the pump chamber P are arranged symmetrically about a rotational center of the internal gear 10 and the discharge spaces H1 and H2 (the high pressure areas) are arranged symmetrically about the rotational center of the internal gear 10. The first intake space L1 and the second intake space L2 are set to have the same pressure (intake pressure) and the first discharge space H1 and the second discharge space H2 are set to have the same pressure (discharge pressure). Thus, the pressure in the internal gear 10 (the internal pressure of the intake spaces L1 and L2 and the internal pressure of the discharge spaces H1 and H2) is diagonally balanced about the axis O1 of the internal gear 10. Thus, pressure directed toward the outer sides, to be applied to the inner circumference surface of the internal gear 10, is offset in the intake spaces L1 and L2 and in the discharge spaces H1 and H2. Thus, the internal gear 10 is less likely to shift toward one side in the pump casing 50 due to the pressure difference, and thus can stably and smoothly rotate with frictional resistance reduced. Thus, the pump can be driven with a smaller amount of driving force.

In the gear pump 1 according to the present embodiment, the first intake space L1 and the second intake space L2 as well as the first discharge space H1 and the second discharge space H2 are arranged symmetrically about the rotational center of the internal gear 10, so that the pressure in the internal gear 10 is balanced. Thus, the internal gear 10 can be self aligned so that the axis O1 of the internal gear 10 and the axis of the housing 40 can be in an appropriate positional relationship, whereby sliding friction between the outer circumference surface of the internal gear 10 and the inner circumference surface of the housing 40 is less likely to be produced. As a result, the pump can have higher machine efficiency with frictional torque loss reduced.

In the gear pump 1 according to the present embodiment, the oil in the first intake space L1 is sent to the first discharge space H1 and the second discharge space H2 respectively through the tooth space 22 of the first external gear 20 and the tooth space 12 of the internal gear 10. Furthermore, the oil in the second intake space L2 is sent to the first discharge space H1 and the second discharge space H2 respectively through the tooth space 32 of the second external gear 30 and the tooth space 12 of the internal gear 10. This ensures two oil sending routes for between the intake spaces L1 and L2 and the discharge spaces H1 and H2. Thus, the oil in the intake spaces L1 and L2 can be efficiently sent to the discharge spaces H1 and H2.

The present invention is not limited to the embodiment described above and can be refined in various ways without departing from the gist of the present invention.

In the example described in the above embodiment, the first external gear and the second external gear have the same shape defined with the outer diameter and the number of teeth. However, this configuration should not be construed in a limiting sense. For example, a first external gear and a second external gear different from each other in the outer diameter, the number of teeth, and the like may be employed.

In the example described in the above embodiment, the internal gear, the first external gear, and the second external gear are linearly arranged. However, this configuration should not be construed in a limiting sense. For example, a configuration in which a line segment between the axes of the internal gear and the first external gear intersects with a line segment between the axes of the internal gear and the second external gear may be employed.

In the example described in the above embodiment, the oil, taken in through a single intake port, is branched by the intake flow channel to be introduced into the first intake space and the second intake space, and the oil discharged from the first discharge space and the oil discharged from the second discharge space are joined at the discharge flow channel to be discharged through a single discharge port. However, this configuration should not be construed in a limiting sense. Two intake ports and two intake spaces may be connected to each other to be in one-to-one relationship, and two discharge ports and two discharge spaces may be connected to each other to be in one-to-one relationship.

In the example described in the above embodiment, the housing includes the pump casing and the pump cover. However, the housing is not limited to a specific mode as long as the hollow portion for accommodating the internal gear and the external gear is provided. For example, a housing including three or more components may be employed.

In the example described in the above embodiment, the present invention is applied to a motor gear pump. However, this configuration should not be construed in a limiting sense. For example, the present invention may be applied to a mechanical gear pump in which one of the external gears 20 and 30 is drivingly rotated by a driving source such as an engine. The gear pump according to the present invention is not limited to an oil pump, and may be applied to pumps for other types of fluid such as air or water for example.

EXPLANATION OF NUMERALS AND CHARACTERS

1 gear pump
10 internal gear
11 internal teeth
12 tooth space
20 first external gear
21 external teeth
22 tooth space
30 second external gear
31 external teeth
32 tooth space
40 housing
50 pump casing
54 partitioning portion
55 first circumference surface
56 second circumference surface
57 third circumference surface
60 pump cover
P pump chamber
P1 first pump chamber
P2 second pump chamber
L1 first intake space
L2 second intake space
H1 first discharge space
H2 second discharge space

The invention claimed is:

1. A gear pump comprising:

an internal gear having an annular shape and having internal teeth on an inner circumference side;

a first external gear and a second external gear each having external teeth on an outer circumference side, the external teeth capable of meshing with the internal teeth, the first external gear and the second external gear being provided on the inner circumference side of the internal gear; and a housing configured to rotatably hold the internal gear, the first external gear, and the second external gear, wherein a pump chamber is defined in the housing by the inner circumference side of the internal gear and the outer circumference sides of the first external gear and the second external gear, the housing comprises a partitioning portion that is provided between the first external gear and the second external gear to divide the pump chamber into a first pump chamber that is provided on the first external gear side and a second pump chamber provided on the second external gear side, the first pump chamber comprises a first intake space into which a fluid is taken in and a first discharge space from which the fluid is discharged, in accordance with rotation of the internal gear and the external gears, the second pump chamber comprises a second intake space into which the fluid is taken in and a second discharge space from which the fluid is discharged, in accordance with rotation of the internal gear and the external gears, the first intake space and the second intake space are provided to be symmetrical about a rotational center of the internal gear, and the first discharge space and the second discharge space are provided to be symmetrical about the rotational center of the internal gear, the housing includes a pump casing including the pump chamber and a pump cover attached to the pump casing covering the pump chamber, the pump cover comprises a first-end cover portion, a middle cover portion and a second-end cover portion, the first-end cover portion has an intake port and a discharge port, the second-end cover portion has a first inlet hole, a first discharge hole, a second inlet hole and a second discharge hole, the middle cover portion has an intake flow channel that establishes connection and communication between the intake port and the first and the second inlet holes, and a discharge flow channel that establishes connection and communication between the discharge port and the first and the second discharge holes, fluid taken-in from the intake port is branched by the intake flow channel and is introduced into the first intake space and the second intake space through the first inlet hole and the second inlet hole, and fluid sent from the first discharge space to the first discharge hole and fluid sent from the second discharge space to the second discharge hole is joined at the discharge flow channel to be discharged through the discharge port.

2. The gear pump according to claim 1, wherein the partitioning portion comprises: a first circumference surface that comes into slidable contact with the external teeth of the first external gear; a second circumference surface that comes into slidable contact with the external teeth of the second external gear; and a pair of third circumference surfaces that come into slidable contact with the internal teeth of the internal gear, wherein the fluid in the first intake space fills a space between a tooth space of the first external gear and the first circumference surface to be sent to the first discharge space and fills a space between a tooth space of the internal gear and one of the third circumference surfaces to be sent to the second discharge space, in accordance with the rotation of the internal gear and the external gears, and wherein the fluid in the second intake space fills a space between a tooth space of the second external gear and the second circumference surface to be sent to the second discharge space and fills a space between a tooth space of the internal gear and another one of the third circumference surfaces to be sent to the first discharge space, in accordance with the rotation of the internal gear and the external gears.

* * * * *